US010203081B2

(12) United States Patent
Matsuda et al.

(10) Patent No.: US 10,203,081 B2
(45) Date of Patent: Feb. 12, 2019

(54) LIGHTING DEVICE AND HEADLIGHT FOR VEHICLE

(71) Applicant: Panasonic Intellectual Property Management Co., Ltd., Osaka (JP)

(72) Inventors: Takashi Matsuda, Osaka (JP); Masahiro Kasano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/925,724

(22) Filed: Mar. 19, 2018

(65) Prior Publication Data

US 2018/0347776 A1 Dec. 6, 2018

(30) Foreign Application Priority Data

Jun. 5, 2017 (JP) ..... 2017-110510

(51) Int. Cl.

| | |
|---|---|
| ***F21S 41/26*** | (2018.01) |
| ***F21S 41/143*** | (2018.01) |
| ***F21S 41/275*** | (2018.01) |
| ***F21Y 115/10*** | (2016.01) |
| ***F21Y 115/20*** | (2016.01) |

(52) U.S. Cl.

CPC ..... *F21S 41/26* (2018.01); *F21S 41/143* (2018.01); *F21S 41/275* (2018.01); *F21Y 2115/10* (2016.08); *F21Y 2115/20* (2016.08)

(58) Field of Classification Search

CPC ..... F21S 41/26; F21S 41/275; F21S 41/143; F21Y 2115/20; F21Y 2115/10

See application file for complete search history.

(56) References Cited

U.S. PATENT DOCUMENTS

| | | | | |
|---|---|---|---|---|
| 2004/0105275 | A1* | 6/2004 | Sazuka | B60Q 1/04 362/507 |
| 2008/0049190 | A1 | 2/2008 | Destain et al. | |
| 2014/0078768 | A1 | 3/2014 | de Lamberterie et al. | |
| 2014/0092619 | A1* | 4/2014 | Bushre | B60Q 1/20 362/520 |

(Continued)

FOREIGN PATENT DOCUMENTS

| | | |
|---|---|---|
| JP | 4083516 B | 4/2008 |
| JP | 2009-545854 | 12/2009 |

(Continued)

*Primary Examiner* — Mary Ellen Bowman

(74) *Attorney, Agent, or Firm* — Wenderoth, Lind & Ponack, L.L.P.

(57) ABSTRACT

A small and thin lighting device with high efficiency and good design and a headlight for a vehicle. A lighting device includes a first lens taking light generated by a light emitting device and emitting the light, and a second lens taking an emitted light from the first lens and emitting the light, in which the second lens is an anamorphic lens in which curvatures are different in a vertical direction and a right and left direction and a center of a lens surface in the vertical direction of the second lens is positioned in an upper direction with respect to an optical axis of the first lens. A headlight for a vehicle including the plural lighting devices is forming a low beam light distribution by superimposing lights from respective lighting devices for irradiation of the center, right and left in a horizontal direction respectively.

7 Claims, 16 Drawing Sheets

(56) References Cited

U.S. PATENT DOCUMENTS

| | | | | |
|---|---|---|---|---|
| 2016/0290583 | A1* | 10/2016 | Suwa ..... | F21S 41/143 |
| 2017/0122528 | A1* | 5/2017 | Kadoriku ..... | F21S 41/00 |

FOREIGN PATENT DOCUMENTS

| | | |
|---|---|---|
| JP | 2014-060155 | 4/2014 |
| WO | 2008/016900 | 2/2008 |
| WO | 2015/076203 | 5/2015 |
| WO | 2015/198527 | 12/2015 |

* cited by examiner

LIGHTING DEVICE AND HEADLIGHT FOR VEHICLE

TECHNICAL FIELD

The technical field relates to a lighting device and a headlight for a vehicle using the lighting device.

BACKGROUND

In a headlight for a vehicle, that is, a so-called low-beam headlight, light higher than a horizontal line is cut in a low beam for preventing an oncoming vehicle or a pedestrian from being dazzled.

Particularly, a luminance intensity distribution in which the light is brighter in a center in a front direction of a road surface in a vehicle travel direction below the horizontal line and reduced above the horizontal line and in the lateral directions is required.

In order to achieve such distribution of light, for example, a lighting device described in Japanese Patent No. 4083516 (Patent Literature 1) is used. The lighting device is shown in FIG. 20.

The lighting device is a so-called multi-eye light including three round lenses 20C, 20C and 20D and four horizontally-long lenses 20A, 20A, 24B and 24B. Seven lights of this light form four types of distributions of light Pa, Pb, Pc and Pd shown in FIG. 21, respectively ranging from narrow to wide in irradiation angle. A low-beam light distribution is formed by superimposing respective lights.

In the related-art lighting device, it is necessary to use a horizontally-long lens or a large-sized lens for forming distributions of light with wide irradiation angles. If a small-sized lens is used, vignetting of light occurs as light is restricted by the size of a lens diameter, which makes formation of distributions of light with wide irradiation angles difficult. There is also a problem that efficiency is reduced when the size is reduced.

SUMMARY

An object of the present disclosure is to provide a lighting device capable of efficiently realizing distributions of light ranging from narrow to wide irradiation angles even with small and thin lenses having excellent design in lens appearance, and a headlight for a vehicle including a plurality of lighting devices.

In order to solve the above problems, a lighting device according to the present disclosure includes a light emitting device, a first lens taking light generated by the light emitting device and emitting the light, and a second lens taking an emitted light from the first lens and emitting the light in a given direction, in which the first lens includes an incident port on which light generated by the light emitting device is incident, an emission port from which light incident on the incident port and passing through the inside of the first lens is emitted, and a side surface portion including a plurality of side wall surfaces provided between the incident port and the emission port, the incident port of the first lens has a concave shape surrounding the light emitting device, having a first incident surface as a concave bottom surface and a second incident surface as a concave side surface, the side surface portion includes a first reflective surface on which light incident on the second incident surface is reflected and a second reflective surface on which light incident on the first incident surface and light reflected on the first reflective surface are reflected, and the second lens is an anamorphic lens in which curvatures are different in a vertical direction and a right and left direction, a light incident part in the vertical direction is formed in a convex shape and the light incident part or a light emission part in the right and left direction is formed in a convex shape, a concave shape or a linear shape.

A center line of a lens surface in the vertical direction of the second lens may be positioned in an opposite direction to the second reflective surface of the first lens with respect to an optical axis of the first lens.

The second lens may be an anamorphic lens in which curvatures of an emission surface are different in the vertical direction and the right and left direction.

The second lens may be a thin lens in which a thickness in the right and left direction is smaller than a thickness in the vertical direction.

A headlight for a vehicle according to the present disclosure includes a plurality of lighting devices, in which respective lighting devices have different distributions of light.

Centers of distributions of light in respective lighting devices of the headlight for the vehicle may be set to a center, right and left with respect to a front center of the vehicle.

A lighting device having a small light distribution angle and a lighting device having a wide light distribution angle may be included in respective lighting devices of the headlight for the vehicle.

Lighting devices in which centers of distributions of light are set to the right and left may be formed by decentering the light incident part and the emission surface of the second lens in a horizontal direction.

In the lighting device according to the present disclosure, light can be efficiently collected by the first lens and can be reflected on the side surface thereof to thereby darken light higher than a horizontal line. The light reflected at that time is superimposed on light which is not reflected and is projected on a lower side of the horizontal line by the second lens. As the light incident part in the vertical direction of the second lens is formed in the convex shape in this case, reflection of light on a side wall of the second lens can be reduced, and stray light as well as reduction in optical efficiency can be prevented. Moreover, curvatures on lens emission surfaces can be the same even in lenses having various lens curvatures, therefore, design in the lens appearance can be improved. As the center of the lens surface in the vertical direction of the second lens is positioned in the upper direction of the optical axis of the first lens, more of the light reflected on the first lens is allowed to be incident on the second lens, which can improve optical efficiency.

As the incident surface or the emission surface of the second lens is formed in a concave lens, irradiation can be performed with a wide distribution of light without reducing efficiency even in a small-sized lens.

In the headlight for the vehicle according to the prevent disclosure, a low beam light distribution can be formed by superimposing center, intermediate and wide distributions of light in respective lighting devices, and light in the intermediate distribution can form a headlight which is bright in right and left in the horizontal direction by further irradiating the center, right and left in the horizontal direction respectively. This is useful at the time of irradiating distant places even when a road surface is curved.

DESCRIPTION OF EMBODIMENTS

Hereinafter, respective embodiments of the present disclosure will be explained with reference to the drawings.

Embodiment 1

FIGS. 1A and 1B to FIG. 5 shows a first lighting device L1 according to Embodiment 1 of the present disclosure.

Figure 1A:
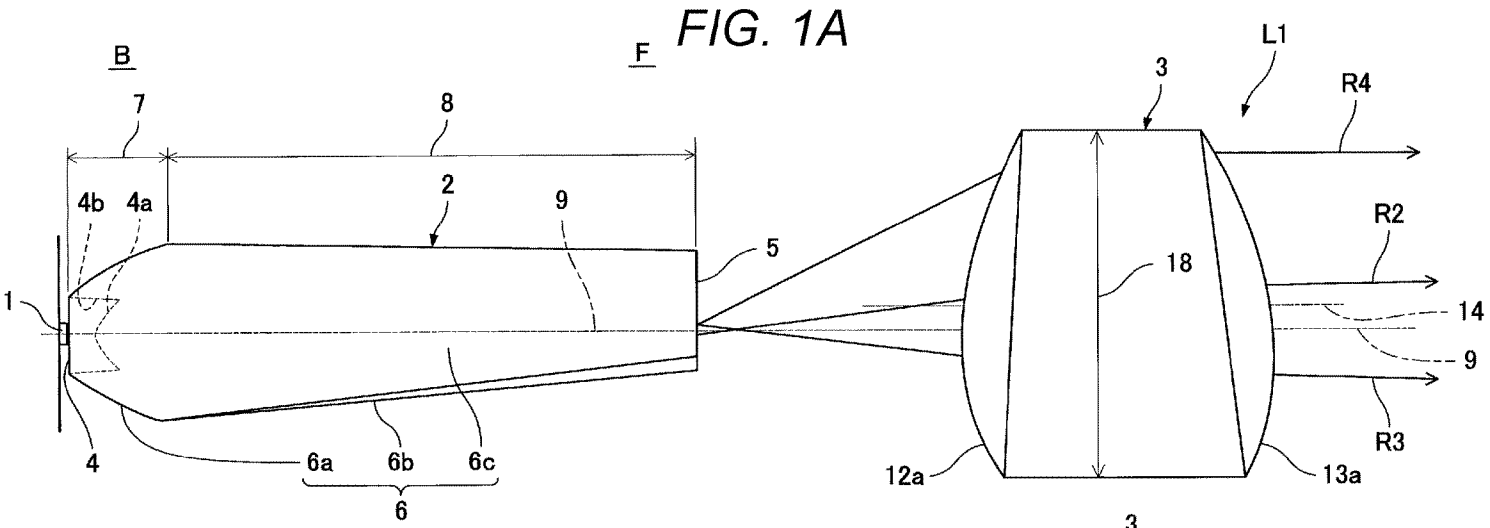
FIG. 1A is aside view and FIG. 1B is a vertical cross-sectional view of a first lighting device according to the present disclosure.
Figure 2A:
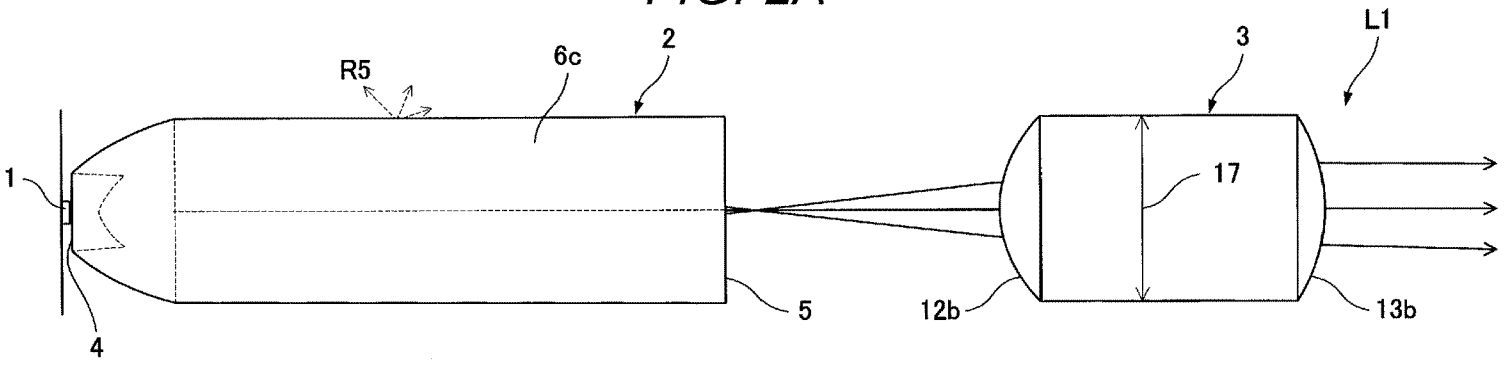
FIG. 2A is a top view and a FIG. 2B is a horizontal cross-sectional view of the first lighting device according to the present disclosure.

FIG. 1A shows a side view of the first lighting device L1 and FIG. 2A shows a top view thereof.

The lighting device includes alight emitting device 1, a first lens 2 taking light generated by the light emitting device 1 and emitting the light and a second lens 3 taking an emitted light from the first lens and emits the light in a given direction. The shape of the first lens 2 is shown in FIGS. 3A to 3D. The light emitting device 1 can be, for example, LED (light emitting diode), OEL (organic electro-luminescence).

In the first lens 2, a first lens incident port 4 on which light generated by the light emitting device 1 is incident is formed on a base end side B as the light emitting device 1 side. The first lens incident port 4 has a concave shape surrounding the light emitting device 1, having a first incident surface 4*a* as a concave-shaped bottom surface and a second incident surface 4*b* as a concave-shaped side surface.

On a tip end side F of the first lens 2, a first lens emission port 5 from which light incident on the first lens incident port 4 and passing through the inside of the first lens 2 is emitted. Aside surface portion 6 including plural side wall surfaces is provided between the first lens incident port 4 and the first lens emission port 5.

The side surface portion 6 includes a first reflective surface 6*a*, a second reflective surface 6*b* and a top surface 6*c*.

The first reflective surface 6*a* is formed in a section 7 in the base end side B of the first lens 2. The shape around an optical axis 9 from the base end side B to the tip end side F is an approximately conical shape the diameter of which is gradually increased. The second reflective surface 6*b* and the top surface 6*c* are formed in a section 8 from the section 7 to the tip end side F. The top surface 6*c* has an arc shape with a single width or an approximately single width toward the tip end side F. The second reflective surface 6*b* is formed on a lower side of the top surface 6*c*. The second reflective surface 6*b* has a shape formed by cutting part of the first lens 2 in a larger area as coming close to the tip end side F, having two surfaces which are a horizontal surface 10 and an inclined surface 11 shown in FIG. 3D. θ1 denotes an inclination of the inclined surface 11.

Figure 1B:
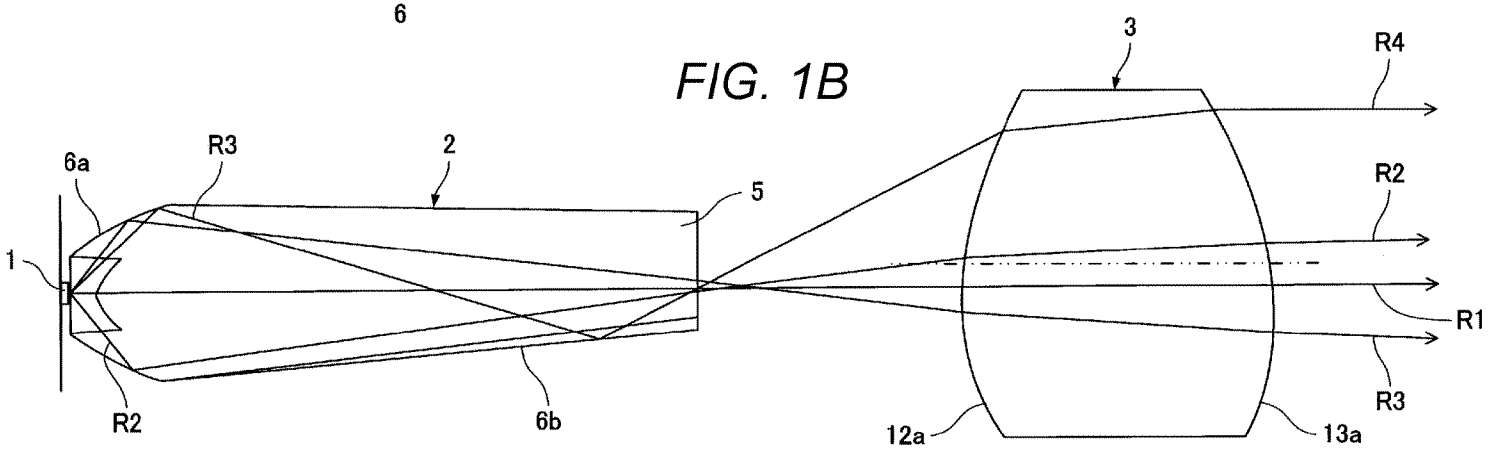
Figure 2B:
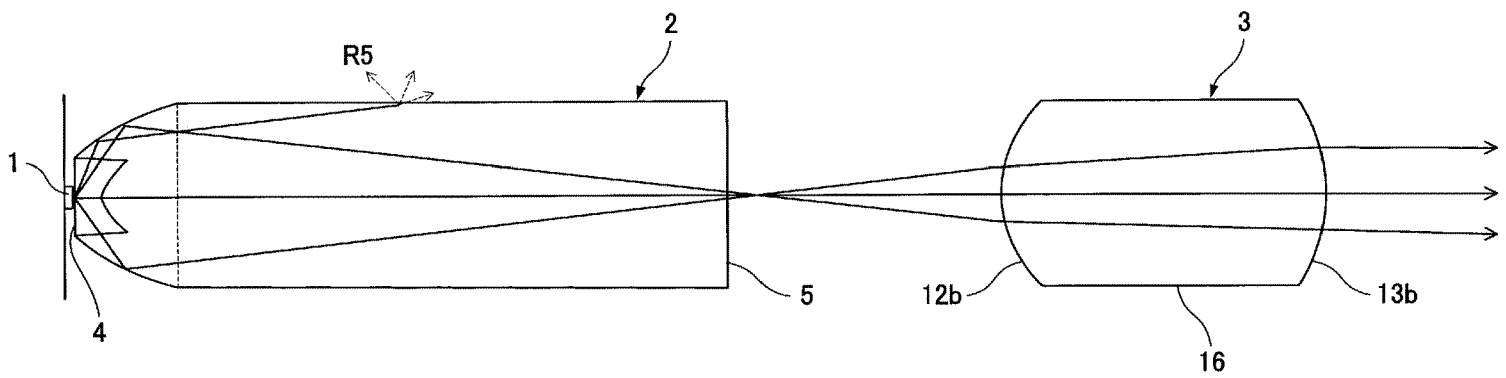
Figure 3A:
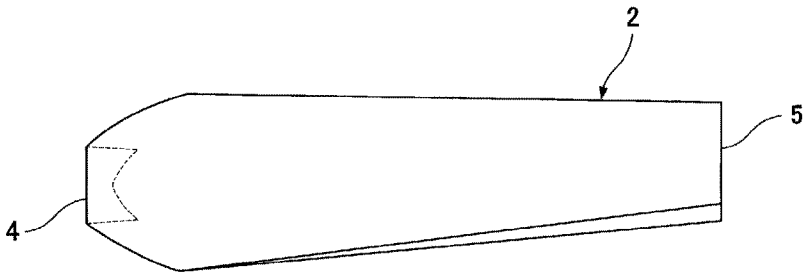
FIG. 3A is a side view.
Figure 3B:
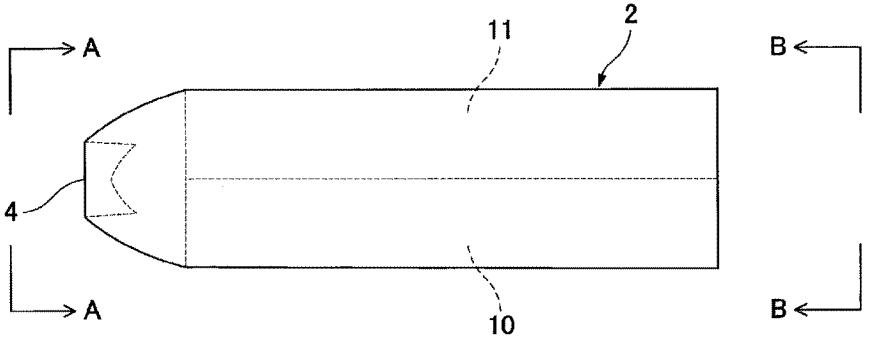
FIG. 3B is a top view.
Figure 3C:
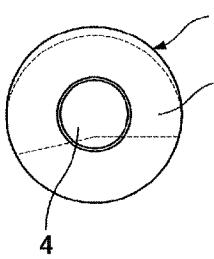
FIG. 3C is a view taken along A-A and FIG. 3D is a view taken along B-B of the first lighting device according to the present disclosure.
Figure 3D:
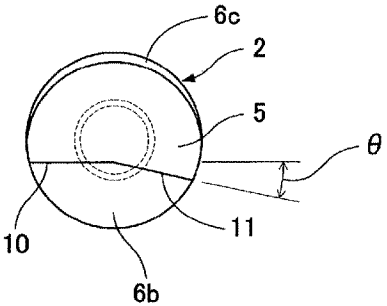

FIG. 1B shows a cross-sectional side view of the first lighting device L1 and FIG. 2B shows a horizontal cross-sectional view of the first lighting device L1.

The first reflective surface 6*a* reflects lights R2, R3 and R4 incident from the second incident surface 4*b* on the inside of the first lens 2. The second reflective surface 6*b* reflects a light R1 incident on the first incident surface 4*a* and the light R4 reflected on the first reflective surface 6*a*. The top surface 6*c* diffuses (R5) or absorbs light incident on the first incident surface 4*a* and light reflected on the first reflective surface 6*a*.

The second lens 3 is an anamorphic convex lens in which curvatures are different in a vertical direction and a right and left direction. A thickness 17 of the second lens 3 in the right and left direction is smaller than a thickness 18 thereof in the vertical direction. Both an incident surface 12*a* in the vertical direction and an incident surface 12*b* in the right and left direction are formed in a convex shape with respect to an optical axis direction. Both a light emission surface 13*a* in the vertical direction of the second lens 3 and a light emission surface 13*b* in the right and left direction are also formed in a convex shape with respect to the optical axis direction. In the embodiment, an optical axis of the second lens 3 is arranged on an extended line of the optical axis 9 of the first lens 2. The second lens 3 is arranged so that a center line 14 of a lens surface in the vertical direction of the second lens 3 is positioned on an upper side of the optical axis 9 of the first lens 2. Specifically, the second lens 3 is positioned in an opposite direction to the second reflection surface 6*b*.

Also in the embodiment, the optical axis of the second lens 3 and the center line 14 of the lens surface in the vertical direction of the second lens 3 are at different positions.

Figure 4:
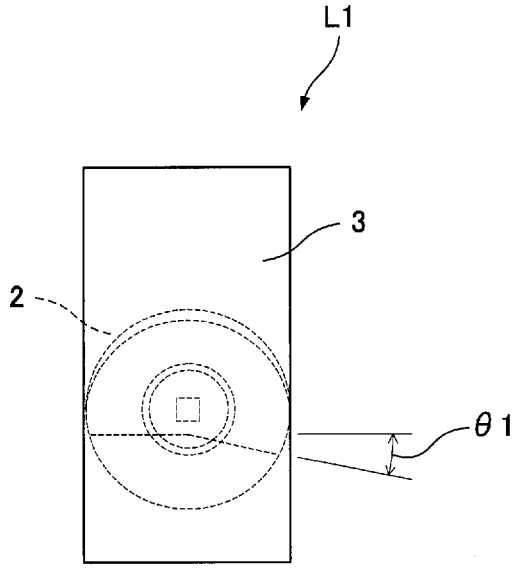
FIG. 4 is a front view of the first lighting device according to the present disclosure.

FIG. 4 is a front view of the first lighting device L1, and the first lens 2 arranged behind the second lens 3 is shown by a broken line.

Figure 5:
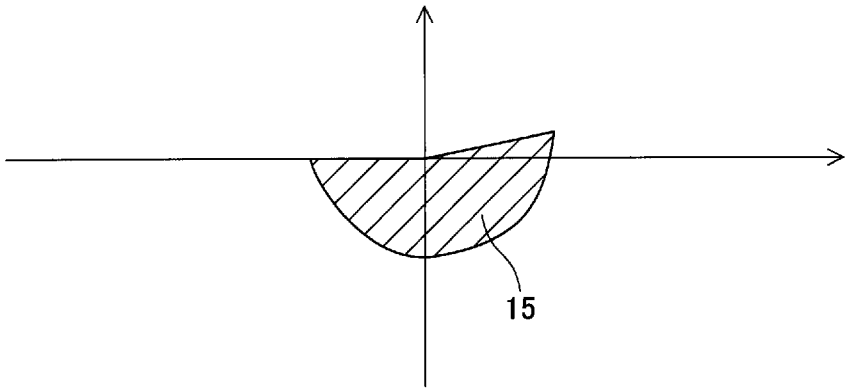
FIG. 5 is a view showing a distribution of light in the first lighting device according to the present disclosure.

FIG. 5 shows a distribution of light 15 obtained by irradiation of the first lighting device L1. A horizontal axis represents a horizontal line and a vertical axis represents a vertical direction. In the distribution of irradiated light, light higher than the horizontal line is reflected on the second reflective surface 6*b* and darkened. A hatched part in FIG. 5 shows a bright area.

When the shape of the second reflective surface 6*b* shown in FIG. 4 is formed of two surfaces which are the horizontal surface 10 and the inclined surface 11, the irradiated light is distributed horizontally and obliquely as shown in FIG. 5.

Here, the top surface 6*c* of the first lens 2 diffuses (R5) or absorbs light, therefore, it is possible to prevent occurrence of stray light at portions other than a central portion.

As the incident surface 12*a* in the vertical direction and the incident surface 12*b* in the right and left direction of the second lens 3 are formed by the convex lens in the first lighting device L1, the magnification of the lens can be adjusted by an light incident part of the second lens 3, therefore, the shape of the light emission surface can be formed with a curvature in consideration of the design of the second lens appearance.

As light is refracted on the light incident part of the second lens 3 to be close to the light axis side, it is possible to prevent light from being internally reflected on a side wall 16 of the second lens 3 and being stray light. Accordingly, a reduction in the utilization efficiency of light can be prevented even when the second lens 3 is reduced in size and in thickness.

The center line 14 of the lens surface in the vertical direction of the second lens 3 is arranged apart from the optical axis 9 in the upper direction, therefore, more light R4 reflected on the second reflective lens 6*b* of the first lens 2 is allowed to be incident on the second lens 3 and the light can be projected from the light emission surface, which can improve the utilization efficiency of light.

Although the center line 14 of the lens surface in the vertical direction of the second lens 3 is different from the optical axis of the second lens 3 in the first lighting device L1 according to Embodiment 1, the center line 14 of the second lens 3 can correspond to the optical axis of the second lens 3.

Embodiment 2

FIGS. 6A and 6B to FIG. 9 show a second lighting device L2 according to Embodiment 2 of the present disclosure.

Figure 6A:
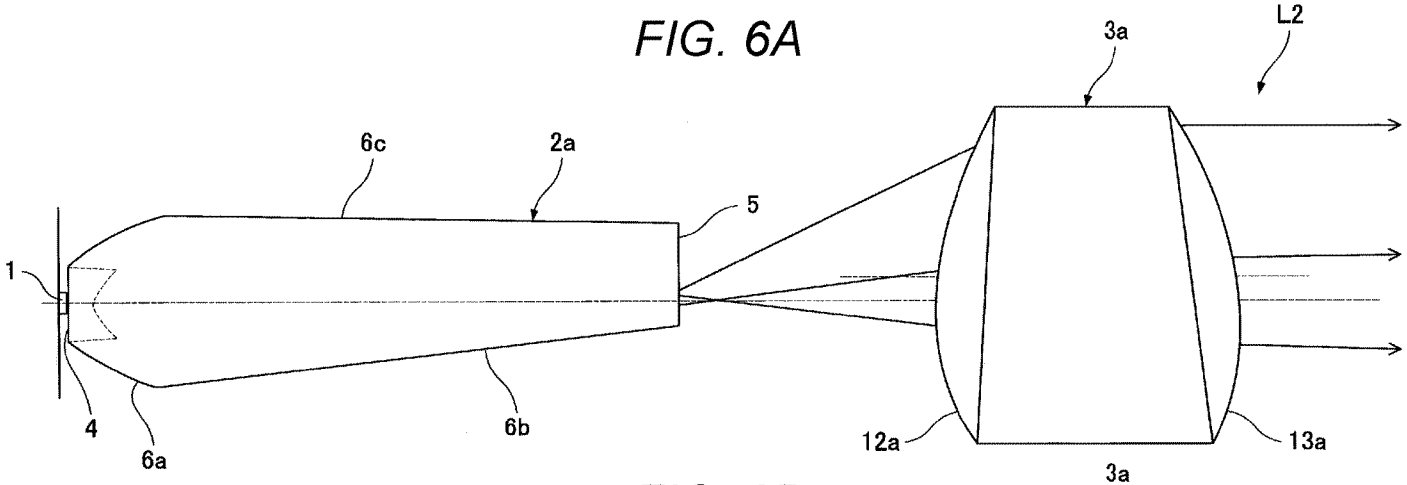
FIG. 6A is aside view and FIG. 6B is a vertical cross-sectional view of a second lighting device according to the present disclosure.
Figure 6B:
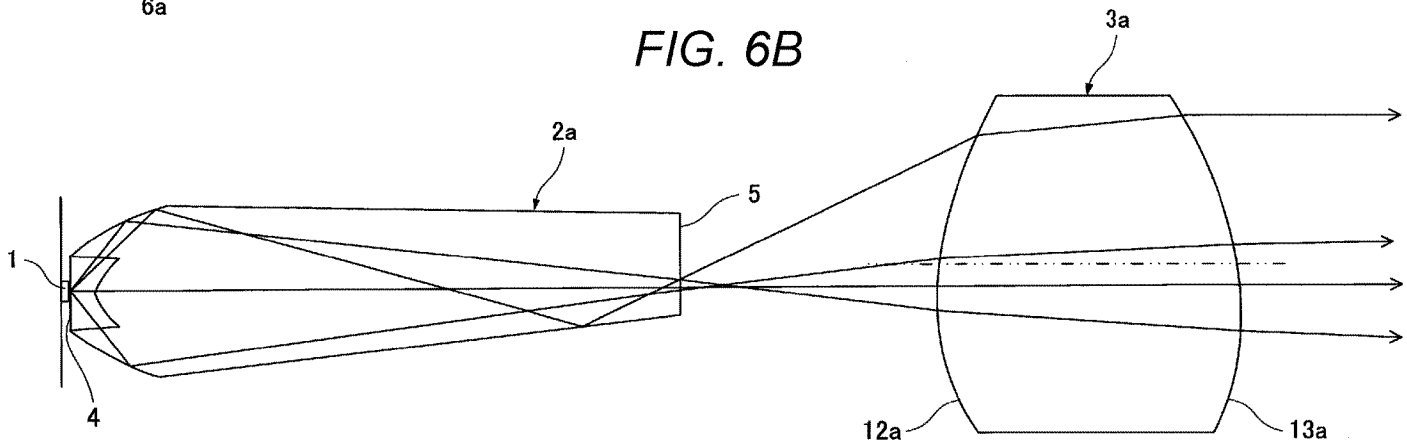
Figure 7:
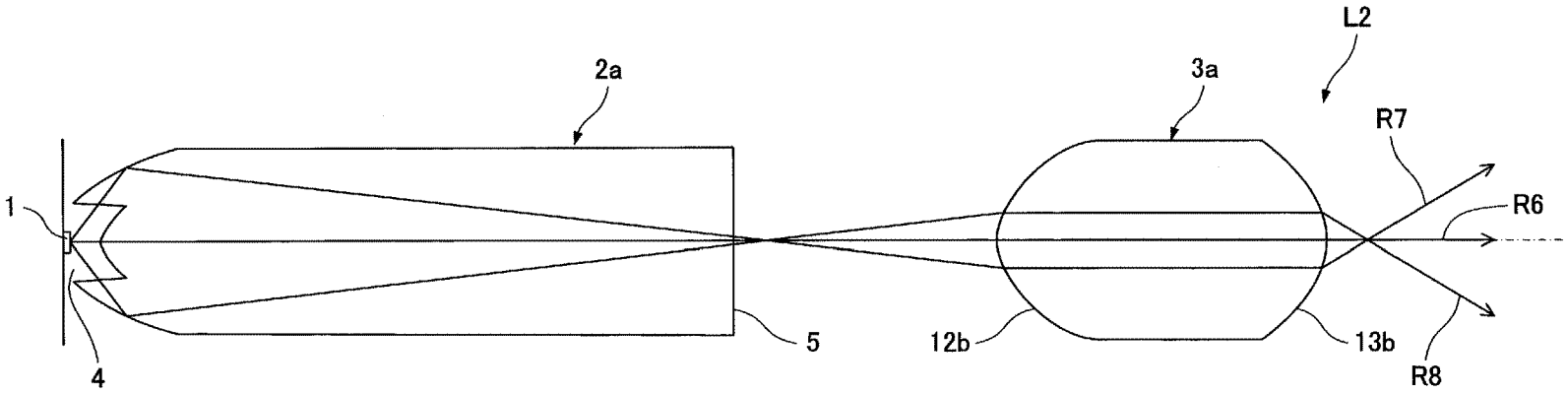
FIG. 7 is a horizontal cross-sectional view of the second lighting device according to the present disclosure.
Figure 8:
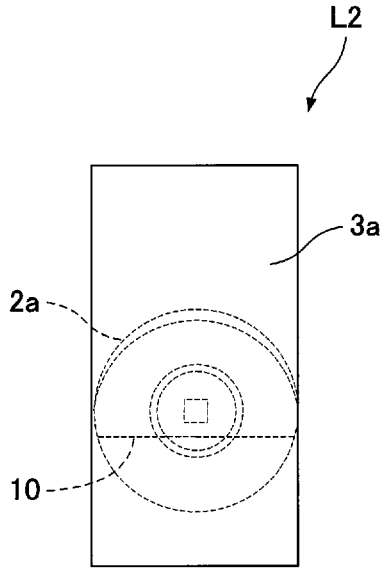
FIG. 8 is a front view of the second lighting device according to the present disclosure.

FIG. 6A is a side view of the second lighting device L2, FIG. 6B is a vertical cross-sectional view of the second lighting device L2, FIG. 7 is a horizontal cross-sectional view of the second lighting device L2 and FIG. 8 shows a front view thereof.

The second lighting device L2 is formed by a first lens 2*a* and a second lens 3*a*. In the first lens 2 according to Embodiment 1, the second reflective surface 6*b* is formed by two surfaces which are the horizontal surface 10 and the inclined surface 11. Embodiment 2 differs from the above only in a point that the second reflective surface 6*b* of the first lens 2*a* is formed only by the horizontal surface 10.

Figure 9:
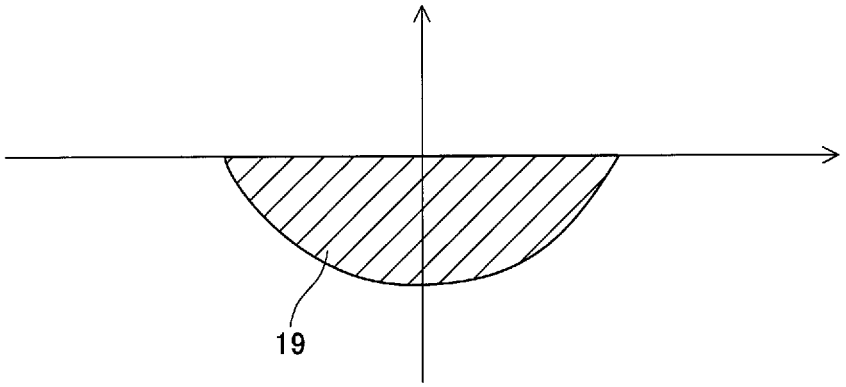
FIG. 9 is a view showing a distribution of light in the second lighting device according to the present disclosure.

The second lens 3*a* according to Embodiment 2 is a thin lens in which a thickness in a right and left direction is smaller than a thickness in a vertical direction. The shape of the incident surface 12*b* in the right and left direction and the shape of the light emission surface 13*b* in the right and left direction in the second lens 3*a* are different from those of the second lens 3 according to Embodiment 1. Specifically, curvatures of the incident surface 12*b* in the right and left direction and the emission surface 13*b* in the right and left direction of the second lens 3*a* are larger than those of the second lens 3. FIG. 9 shows a distribution of light irradiated by the lighting device.

According to the above structure, the horizontal light emitted from the first lens 2*a* is bent in directions of R6, R7 and R8 as shown in FIG. 7, forming a distribution of light 19 expanding in the horizontal direction as shown in FIG. 9. As the curvature of the incident surface 12*b* in the right and left direction is larger than that of the first lens 2 according to Embodiment 1 in this case, there are effects that light is bent in a larger scale and the magnification of the lens becomes larger than that of the first lens 2 to widen the light in the horizontal direction. Accordingly, a wider distribution of light can be obtained without reducing utilization efficiency of light even in the small-sized thin lens.

Furthermore, as the curvature of the emission surface 13*b* in the right and left direction can be reduced as compared with the curvature of the incident surface 12*b* in the right and left direction as the curvatures of incident surfaces of both convex lenses, for example, it is possible to form a lens having an appearance with the same curvature as the first lighting device L1, which increases a degree of freedom in design.

Embodiment 3

FIGS. 10A and 10B to FIG. 13 show a third lighting device L3 according to Embodiment 3 of the present disclosure.

Figure 10A:
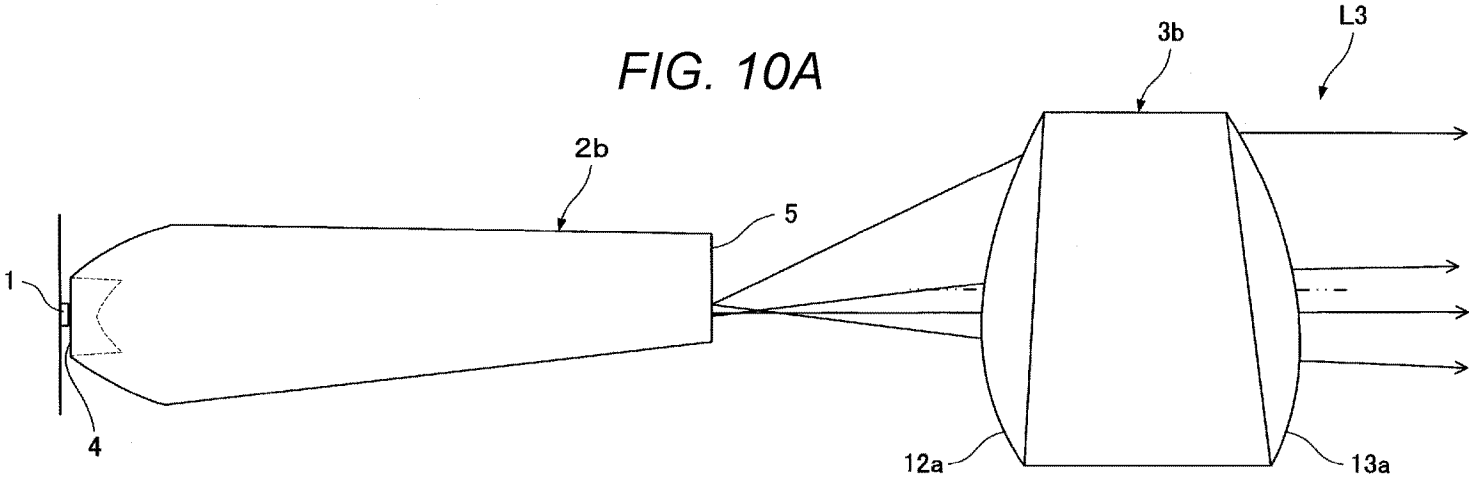
FIG. 10A a side view and FIG. 10B is a vertical cross-sectional view of a third lighting device according to the present disclosure.
Figure 10B:
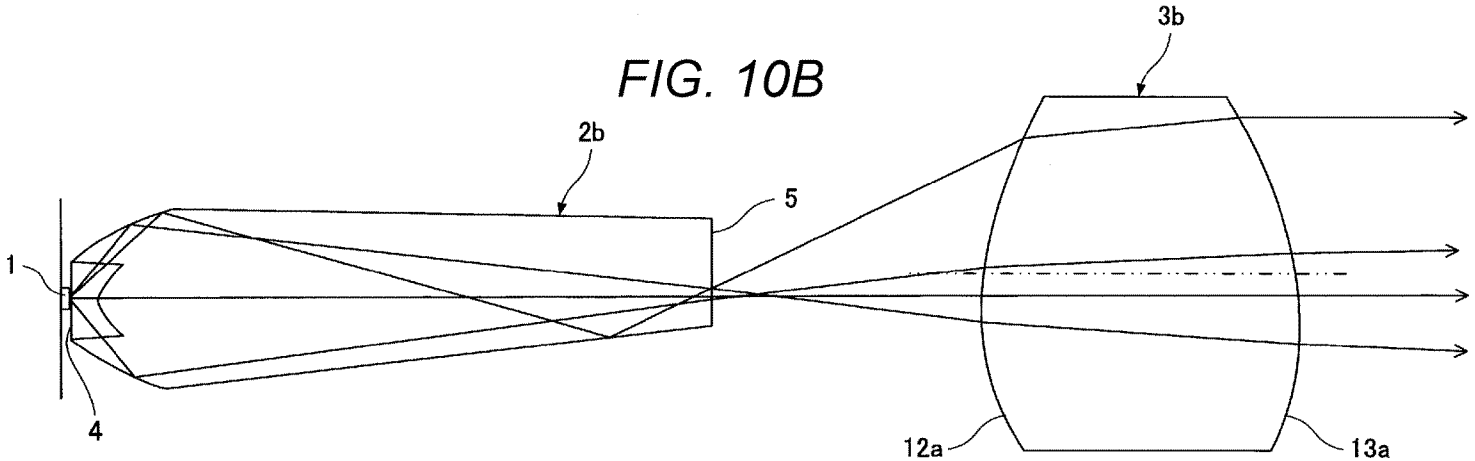
Figure 11A:
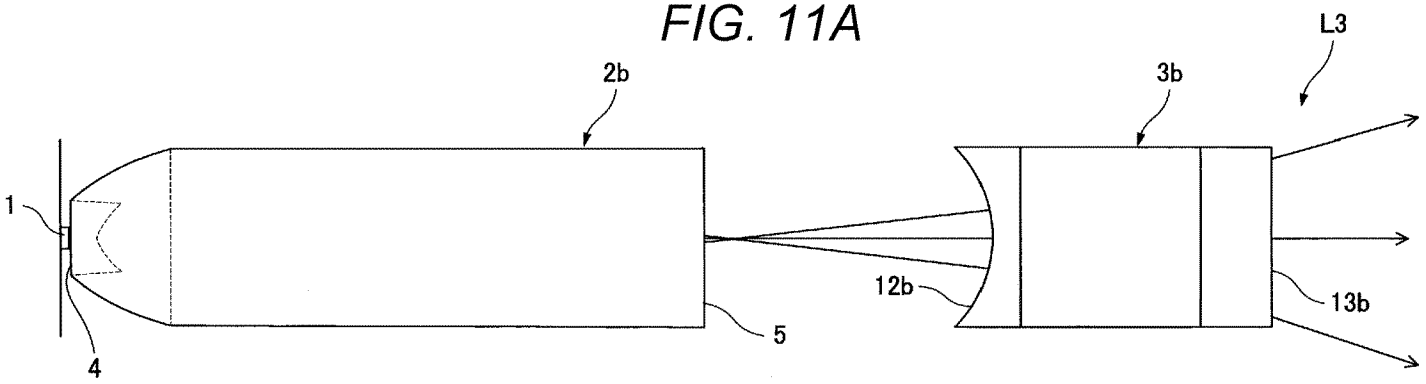
FIG. 11A is a top view and a FIG. 11B is a horizontal cross-sectional view of the third lighting device according to the present disclosure.
Figure 11B:
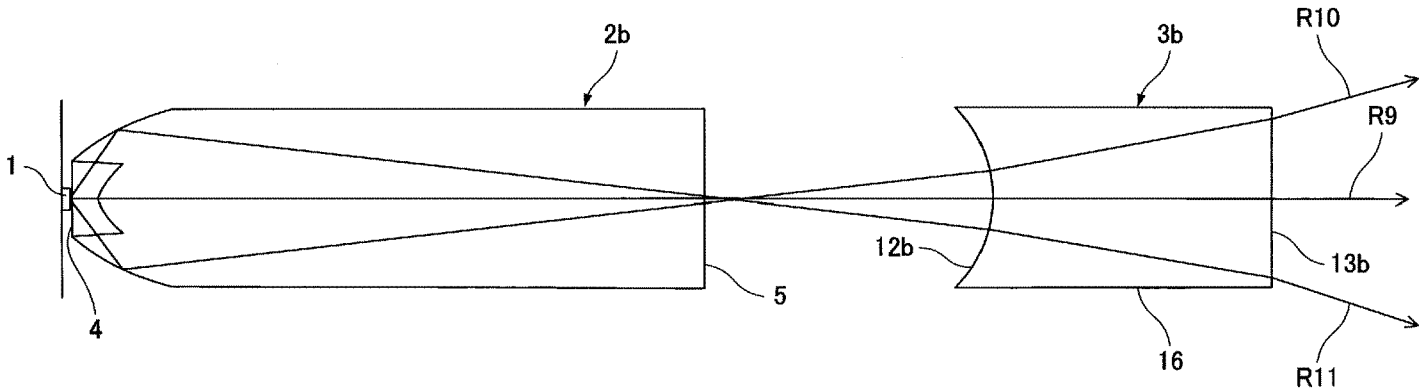
Figure 12:
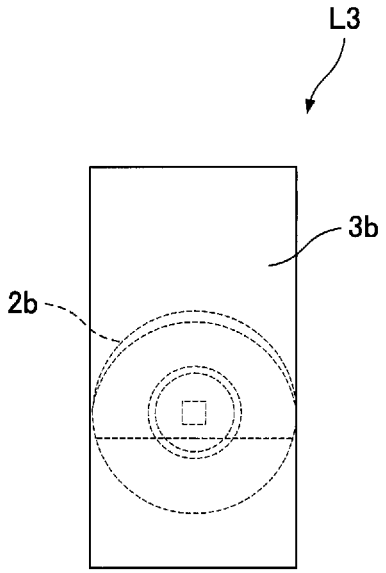
FIG. 12 is a front view of the third lighting device according to the present disclosure.

FIG. 10A is a side view of the third lighting device L3, FIG. 10B is a vertical cross-sectional view of the third lighting device L3, FIG. 11A is a top view of the third lighting device L3, FIG. 11B is a horizontal cross-sectional view of the third lighting device L3 and FIG. 12 shows a front view thereof.

The third lighting device L3 is formed by a first lens 2*b* and a second lens 3*b*. The first lens 2*b* is the same as the first lens 2*a* according to Embodiment 2.

The second lens 3*b* is a thin lens in which a thickness in a right and left direction is smaller than a thickness in a vertical direction. The shape of the incident surface 12*b* in the right and left direction and the shape of the light emission surface 13*b* in the right and left direction in the second lens 3*a* are different from those of the second lens 3*a* according to Embodiment 2.

Specifically, the incident surface 12*a* in the vertical direction and the light emission surface 13*a* in the vertical direction of the second lens 3*b* have a convex shape protruding in the optical axis direction as shown in FIGS. 10A and 10B. The incident surface 12*b* in the right and left direction of the second lens 3*b* has a concave shape concaved in the optical axis direction toward the inside of the second lens 3*b* as shown in FIGS. 11A and 11B, having a so-called reverse saddle shape. The incident surface 12*b* in the right and left direction of the second lens 3*b* has a linear shape as shown in FIGS. 11A and 11B and the shape of the emission surface has a convex curved surface in the vertical direction and a linear cylindrical shape in the right and left direction.

Figure 13:
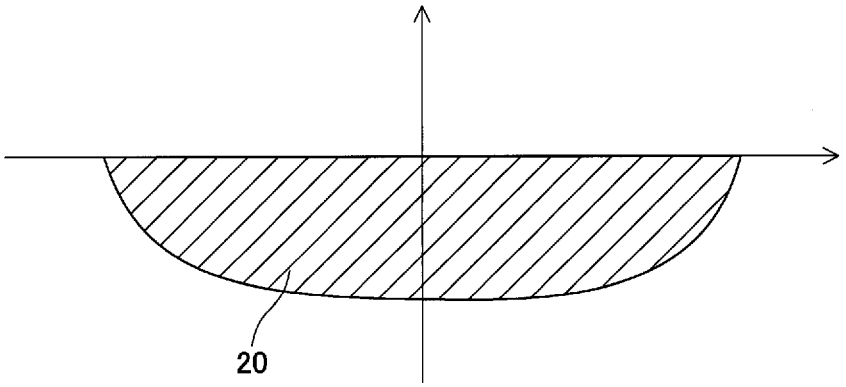
FIG. 13 is a view showing a distribution of light in the third lighting device according to the present disclosure.

According to the above structure, the horizontal light emitted from the first lens 2*b* is expanded in the right and left direction as shown by R9, R10 and R11 of FIG. 11B by the light incident part of the second lens 3*b*. The light forms a distribution of light 20 expanded in the horizontal direction as shown in FIG. 13. As the incident surface 12*b* in the right and left direction has a concave-shaped curvature in this case, there are effects that light is scattered at larger angles and light is further expanded in the horizontal direction as compared with the second lighting device L2. Accordingly, a wider distribution of light can be obtained without reducing utilization efficiency of light even in the small-sized thin lens.

Embodiment 4

FIGS. 14A and 14B to FIG. 17 show a fourth lighting device L4 according to Embodiment 4 of the present disclosure.

Figure 14A:
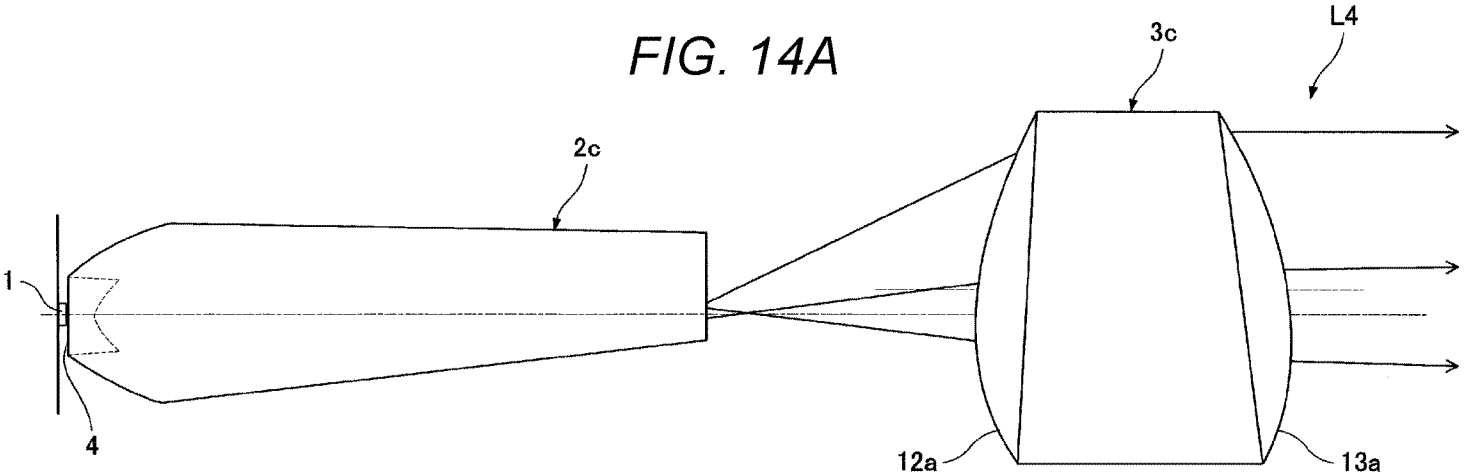
FIG. 14A is a side view and a FIG. 14B is a vertical cross-sectional view of a fourth lighting device according to the present disclosure.
Figure 14B:
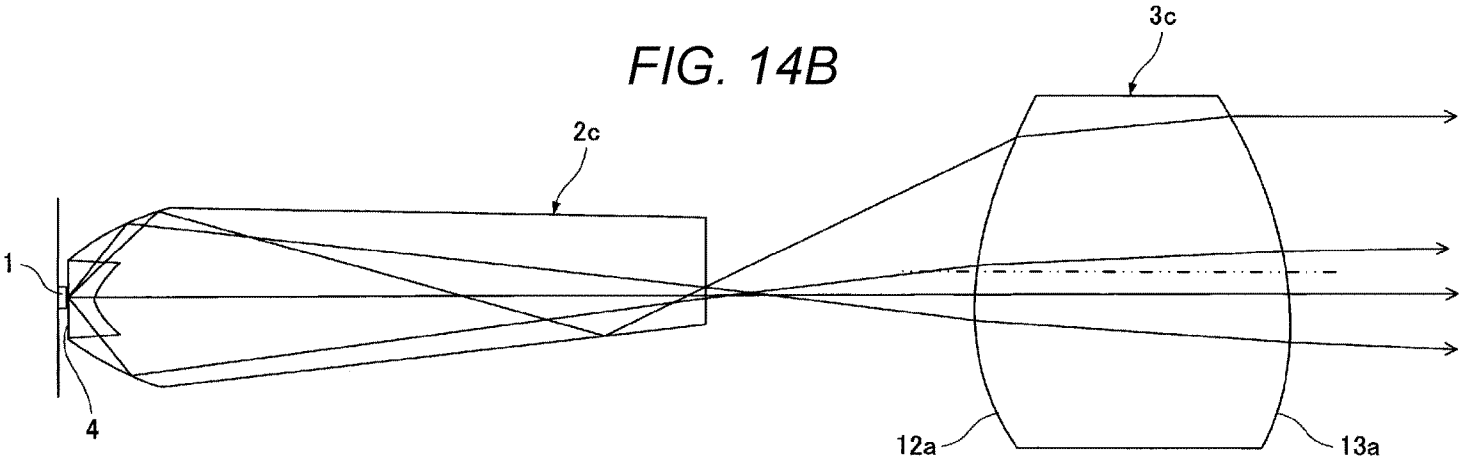
Figure 15:
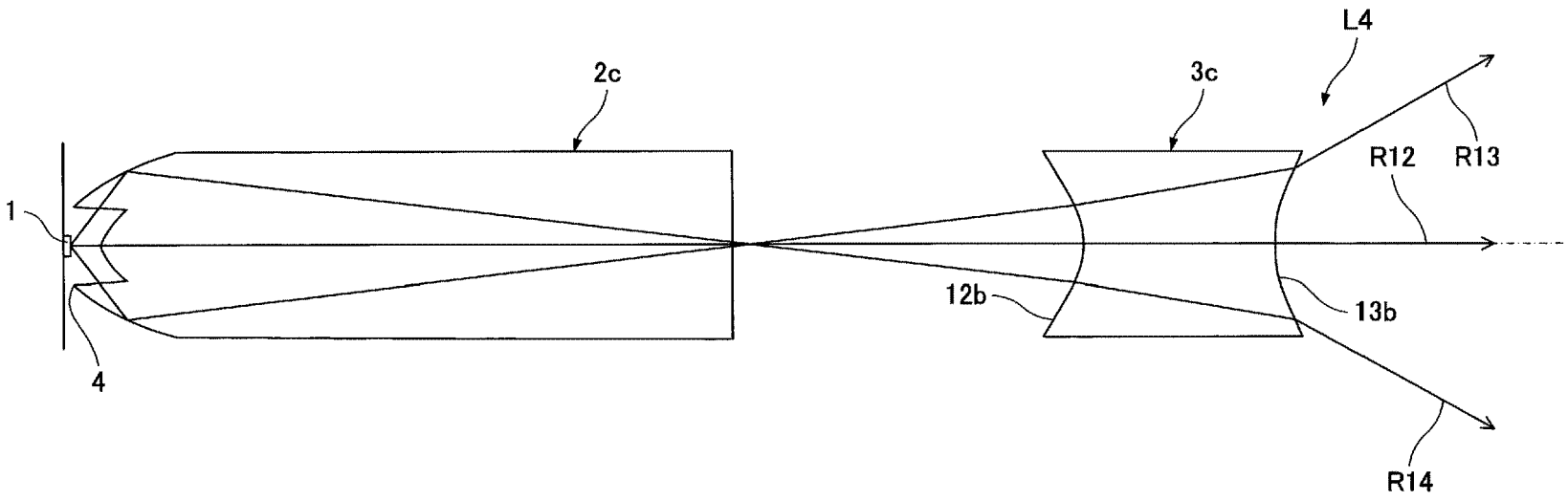
FIG. 15 is a horizontal cross-sectional view of the fourth lighting device according to the present disclosure.
Figure 16:
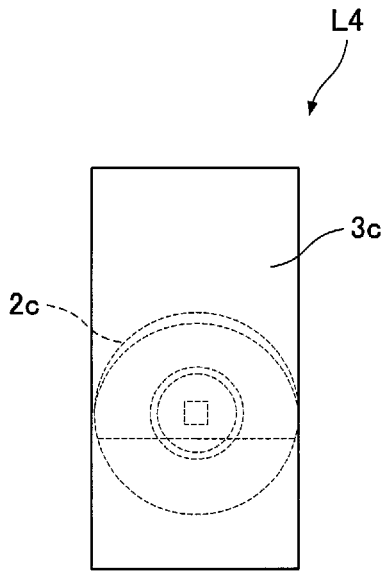
FIG. 16 is a front view of the fourth lighting device according to the present disclosure.

FIG. 14A is a side view of the fourth lighting device L4, FIG. 14B is a vertical cross-sectional view of the fourth lighting device L4, FIG. 15 is a horizontal cross-sectional view of the fourth lighting device L4 and FIG. 16 shows a front view thereof.

The fourth lighting device L4 is formed by a first lens 2*c* and a second lens 3*c*. The first lens 2*c* is the same as the first lens 2*a* according to Embodiment 2.

The incident surface 12*a* in the vertical direction and the incident surface 12*b* in the right and left direction of the second lens 3*c* are the same as those of the third lighting device L3. The light emission surface 13*a* in the vertical direction of the second lens 3*c* has a convex shape and the light emission surface 13*b* in the right and left direction has a concave shape. The shape of the light emission surface is a reverse saddle shape that is concave toward the inside of the second lens 3*c*.

Figure 17:
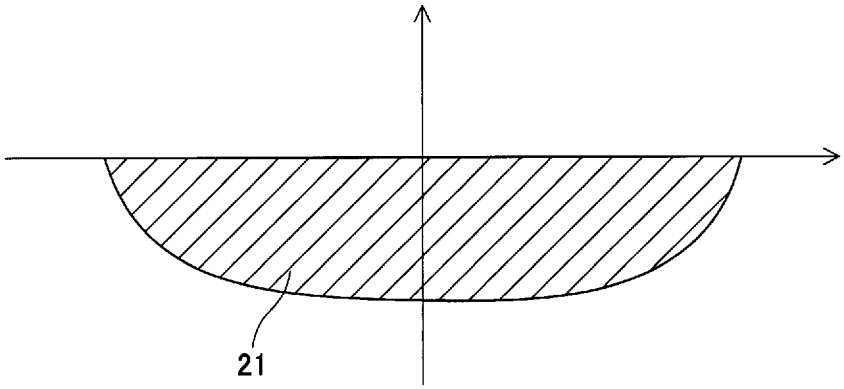
FIG. 17 a view showing a distribution of light in the fourth lighting device according to the present disclosure.

According to the above structure, the horizontal light emitted from the first lens 2*c* is expanded in the right and left direction as shown by R12, R13 and R14 in FIG. 15 by the light incident part of the second lens 3*c* and is further expanded in the right and left direction by the light emission surface 13*b* in the right and left direction. The light forms a distribution of light 21 expanded in the horizontal direction as shown in FIG. 17.

As the light emission surface 13*b* in the right and left direction has a concave-shaped curvature in this case, there are effects that light is scattered at larger angles and light is further expanded in the horizontal direction as compared with the third lighting device L3. Accordingly, a wider distribution of light can be obtained without reducing utilization efficiency of light even in the small-sized thin lens.

Embodiment 5

Figure 18:
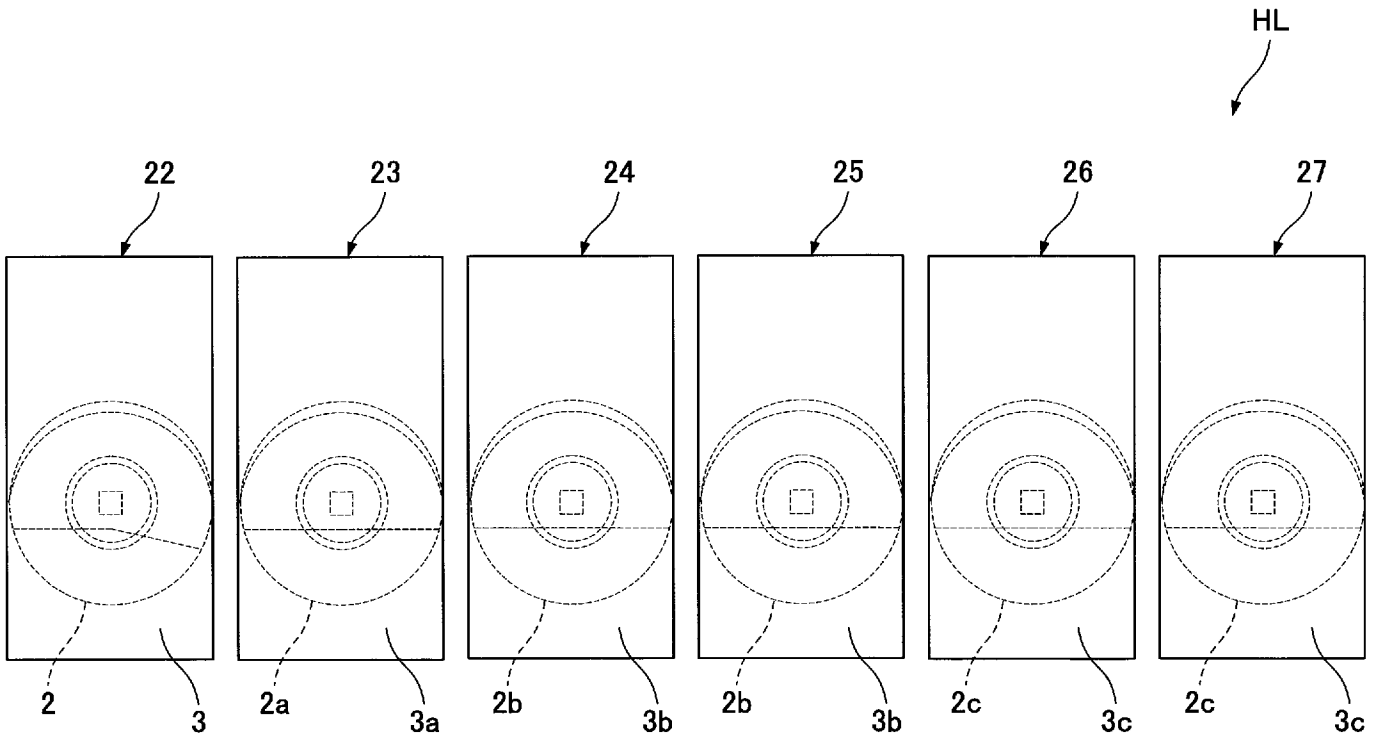
FIG. 18 is a front view of a headlight for a vehicle according to the present disclosure.
Figure 19:
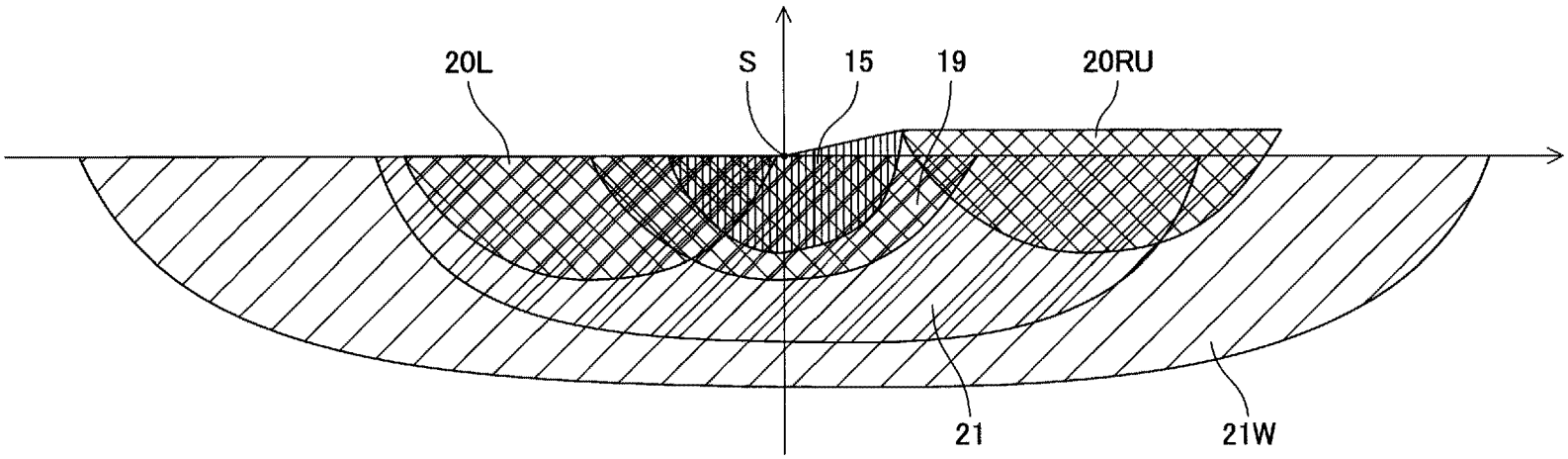
FIG. 19 is a view showing a distribution of light of the headlight for the vehicle according to the present disclosure.
Figure 20:
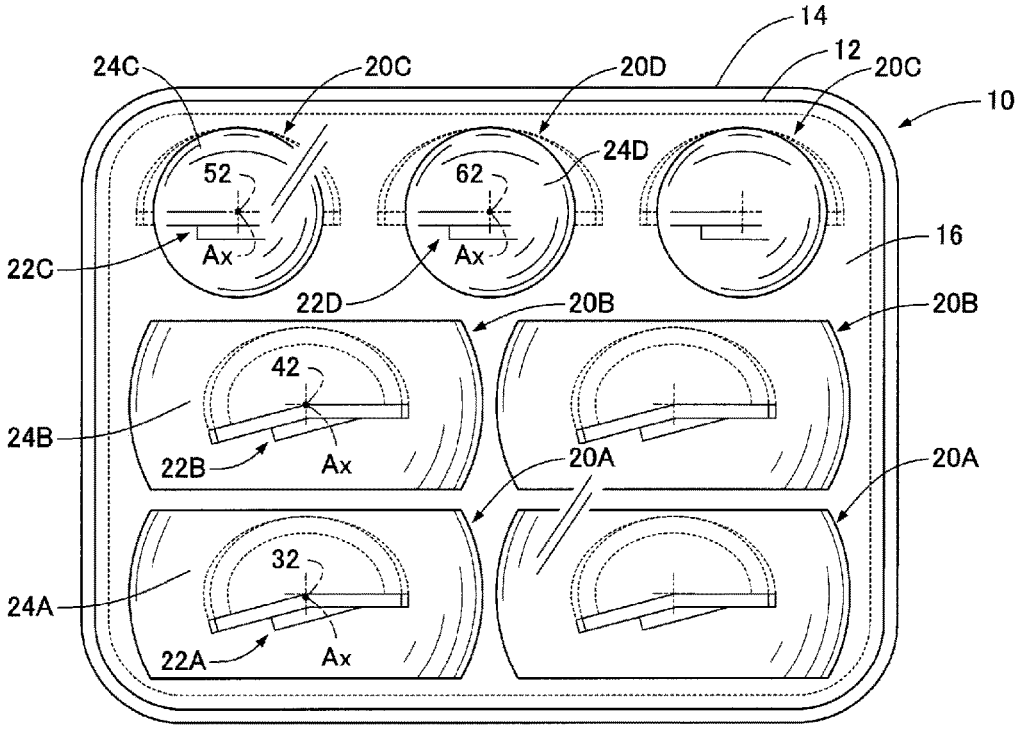
FIG. 20 Prior Art
FIG. 20 is a front view showing lighting devices in Patent Literature 1.
Figure 21:
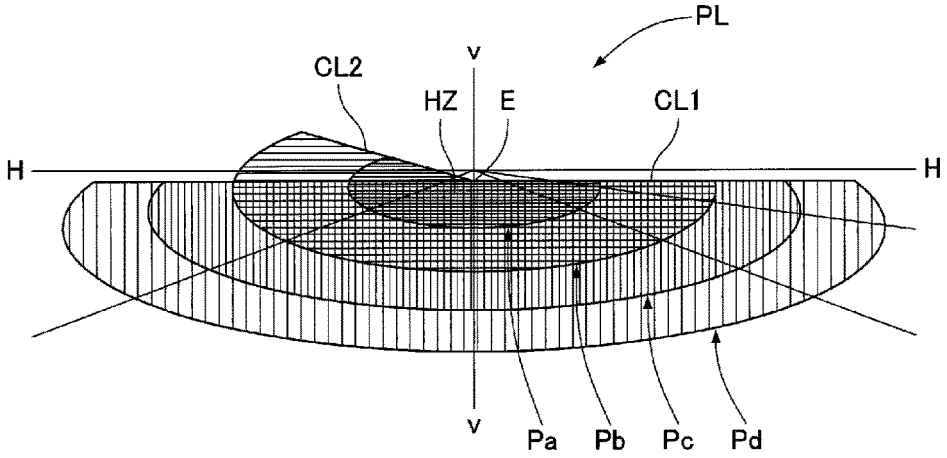
FIG. 21 Prior Art
FIG. 21 is a view showing distributions of light of the lighting devices in the Patent Literature 1.

FIG. 18 and FIG. 19 show a headlight for a vehicle HL according to Embodiment 5 of the present disclosure.

FIG. 18 is a front view of the headlight for the vehicle HL seen form the side of the emission surface, in which the sum total of six lighting devices 22, 23, 24, 25, 26 and 27 are arranged in the right and left direction. Respective lighting devices 22, 23, 24, 25, 26 and 27 have different distributions of light. FIG. 19 shows distributions of light of the headlight for the vehicle HL. The distributions of light shown in FIG. 19 show a light distribution pattern for a low beam formed on a virtual vertical screen arranged at a position of 25*m* in front of the headlight for the vehicle HL. As can be seen, centers of distributions of light in respective lighting devices are set in the center, right and left with respect to a front center S of the vehicle.

The lighting devices 22 and 23 on the left side correspond to the first lighting device L1 explained in Embodiment 1 and the second lighting device L2 explained in Embodiment 2. A pattern of light irradiated by the lighting device 22 corresponds to a light distribution position 15 in FIG. 19. A pattern of light irradiated by the lighting device 23 is set to a light distribution position 19 in FIG. 19. Both the lighting devices 24 and 25 adjacent to the lighting device 23 on the right side correspond to the third lighting device L3 explained in Embodiment 3.

In order to set distributions of light of the lighting devices 24 and 25 to left or right, it can be realized by decentering the second lens 3*b* in the horizontal direction. "Decentering" in this case indicates that an apex on a lens curved surface is shifted from the optical axis. In the headlight for the vehicle HL, a pattern of light irradiated by the lighting device 24 is set to a distribution of light 20L in FIG. 19 by decentering the second lens 3*b* of the lighting device 24 in the horizontal direction so that the pattern of light is shifted from the front center S of the vehicle to the left. Concerning the lighting device 25, a pattern of light irradiated by the lighting device 25 is set to a distribution of light 20RU in FIG. 19 by decentering the second lens 3*b* of the lighting device 25 in the horizontal direction so that the pattern of light irradiated by the lighting device 25 is shifted from the front center S of the vehicle to right as well as by decentering the second lens 3*b* of the lighting device 25 in the vertical direction so that the distribution of light from the lighting device 25 is arranged in an upper position.

Both the lighting devices 26 and 27 adjacent to the lighting device 25<<only one lighting device 26 shown in FIG. 18. Are there 2 lighting devices 26 or typo?>> on the right side correspond to the fourth lighting device L4 explained in Embodiment 4. A pattern of light irradiated by the lighting device 26 is set to the distribution of light 21 in FIG. 19. A pattern of light irradiated by the lighting device 27 is set to a distribution of light 21W in FIG. 19.

According to the above structure, the distribution of light of the headlight for the vehicle HL is formed by superimposing the distributions of light 15, 19, 20L, 20RU, 21 and 21W. Accordingly, a distribution of light in which light higher than the horizontal line is dark, light is gathered on a lower side of the horizontal line, the center is the brightest, the right and left direction is also bright and further, an outer side and a lower side are gradually darker is formed.

The above distribution of light is suitable for the low beam. A headlight which is bright in right and left in the horizontal direction can be formed by irradiating the center, right and left in the horizontal direction respectively with light in an intermediate distribution of light. This is useful at the time of irradiating distant places even when a road surface is curved.

Although the lighting devices having the total six types of distributions of light are aligned in this case, the present disclosure is not limited to this, and the distribution of light can be formed by various combinations when light distribution angles representing spreading angles of light from the center in a vehicle travelling direction have three kinds or more including a small light distribution angle, an intermediate light distribution angle and a wide light distribution angle. It is also naturally possible to install a plurality of lighting devices having the same kind of distribution of light.

The lighting device according to the present disclosure is useful for the lighting device forming the headlight of the vehicle.

What is claimed is:

1. A headlight for a vehicle comprising:

a plurality of lighting devices arranged in a right and left direction, each having a different distribution of light and each comprising:

a light emitting device;

a first lens taking light generated by the light emitting device and emitting the light; and a second lens taking an emitted light from the first lens and emitting the light in a given direction, wherein the first lens includes an incident port on which light generated by the light emitting device is incident, an emission port from which light incident on the incident port and passing through the inside of the first lens is emitted, and a side surface portion including a plurality of side wall surfaces provided between the incident port and the emission port, the incident port of the first lens has a concave shape surrounding the light emitting device, having a first incident surface as a concave bottom surface and a second incident surface as a concave side surface, the side surface portion includes a first reflective surface on which light incident on the second incident surface is reflected and a second reflective surface on which light incident on the first incident surface and light reflected on the first reflective surface are reflected, and the second lens is an anamorphic lens in which curvatures are different in a vertical direction and a right and left direction, and includes a light incident part in the vertical direction formed in a convex shape and a light emission part, wherein the light incident part or the light emission part in the right and left direction is formed in a convex shape, a concave shape or a linear shape;

wherein the second lens is a thin lens in which a thickness in the right and left direction is smaller than a thickness in the vertical direction.

2. The headlight according to claim 1, wherein a center line of a lens surface in the vertical direction of the second lens is positioned in an opposite direction to the second reflective surface of the first lens with respect to an optical axis of the first lens.

3. The headlight according to claim 2, wherein the second lens is an anamorphic lens in which curvatures of an emission surface are different in the vertical direction and the right and left direction.

4. The headlight for the vehicle according to claim 1, comprising three of said lighting devices, wherein centers of distributions of light in the three lighting devices are set to a center, right and left, respectively, with respect to a front center of the vehicle.

5. The headlight for the vehicle according to claim 1, wherein at least one of said lighting devices has a comparatively small light distribution angle and another at least one of said lighting devices has a comparatively wide light distribution angle compared to each other.

6. The headlight for the vehicle according to claim 4, wherein the lighting devices in which centers of distributions of light are set to the right and left are formed by decentering the light incident part and the emission surface of the respective second lens in a horizontal direction.

7. A headlight for a vehicle comprising:

a plurality of lighting devices arranged in a right and left direction, each having a different distribution of light and each comprising:

a light emitting device;

a first lens; and a second lens arranged so that the first lens is between the second lens and the light emitting device, wherein the first lens includes an incident port, an emission port, and a side surface portion including a plurality of side wall surfaces provided between the incident port and the emission port, wherein the incident port of the first lens has a concave shape surrounding the light emitting device, having a first incident surface as a concave bottom surface and a second incident surface as a concave side surface, wherein the side surface portion includes a first reflective surface and a second reflective surface, and wherein the second lens is a thin lens in which a thickness in the right and left direction is smaller than a thickness in the vertical direction and is an anamorphic lens in which curvatures are different in a vertical direction and a right and left directions, and includes a light incident part in the vertical direction formed in a convex shape and a light emission part, wherein the light incident part or the light emission part in the right and left direction is formed in a convex shape, a concave shape or a linear shape.

* * * * *